US009909552B2

(12) United States Patent
Ikeda

(10) Patent No.: US 9,909,552 B2
(45) Date of Patent: Mar. 6, 2018

(54) PLASMA GENERATING DEVICE, AND INTERNAL COMBUSTION ENGINE

(75) Inventor: Yuji Ikeda, Kobe (JP)

(73) Assignee: IMAGINEERING, INC., Hyogo (JP)

( * ) Notice: Subject to any disclaimer, the term of this patent is extended or adjusted under 35 U.S.C. 154(b) by 578 days.

(21) Appl. No.: 14/233,067

(22) PCT Filed: Jul. 13, 2012

(86) PCT No.: PCT/JP2012/068011

§ 371 (c)(1),
(2), (4) Date: Apr. 2, 2014

(87) PCT Pub. No.: WO2013/011968

PCT Pub. Date: Jan. 24, 2013

(65) Prior Publication Data

US 2014/0202411 A1 Jul. 24, 2014

(30) Foreign Application Priority Data

Jul. 16, 2011 (JP) ..... 2011-157285
Aug. 25, 2011 (JP) ..... 2011-184066

(51) Int. Cl.
*H05H 1/04* (2006.01)
*F02P 19/04* (2006.01)
(Continued)

(52) U.S. Cl.
CPC ..... *F02P 23/045* (2013.01); *F02M 27/042* (2013.01); *F02P 3/01* (2013.01); *F02P 23/04* (2013.01); *H05H 1/00* (2013.01); *H05H 1/04* (2013.01); *H05H 1/46* (2013.01); *H05H 2001/463* (2013.01)

(58) Field of Classification Search
CPC ..... H05H 1/04; H05H 1/00; H05H 1/0081; H05H 1/18; H05H 1/46; H05H 2001/4607; F02B 1/02; F02B 9/00; F02B 9/12; F02B 23/08; F02M 27/04; F02M 27/065; F02M 27/042; F02M 27/06; F02M 2027/047; F02P 9/007; F02P 23/04; F02P 23/045
See application file for complete search history.

(56) References Cited

U.S. PATENT DOCUMENTS 4,996,967 A 3/1991 Rosswurm et al.
5,160,397 A * 11/1992 Doki ..... H05H 1/46 118/719
(Continued)

FOREIGN PATENT DOCUMENTS

JP 03-264772 A 11/1991
JP 2006-525111 A 11/2006
(Continued)

OTHER PUBLICATIONS

International Search Report dated Nov. 20, 2012, issued in corresponding application No. PCT/JP2012/068011.

*Primary Examiner* — Lindsay Low
*Assistant Examiner* — George Jin
(74) *Attorney, Agent, or Firm* — Westerman, Hattori, Daniels & Adrian

(57) ABSTRACT

To downsize an electromagnetic wave generation device in a plasma generation device that generates electromagnetic wave plasma by emitting to a target space an electromagnetic wave amplified by means of a solid state amplifying element. The plasma generation device includes the electromagnetic wave generation device that outputs the electromagnetic wave amplified by means of the solid state amplifying element, and an emission antenna for emitting the electromagnetic wave outputted from the electromagnetic wave generation device to the target space. The plasma generation device causes the emission antenna to emit the electromagnetic wave to the target space, thereby generating the electromagnetic wave plasma. The plasma generation device has a characteristic that an output waveform of the electromagnetic wave generation device has a peak during a rise, and is adapted to output the electromagnetic wave to the emission antenna without reducing the peak during the rise of the output waveform.

9 Claims, 6 Drawing Sheets

(51) Int. Cl.

| | |
|---|---|
| ***F02P 23/04*** | (2006.01) |
| ***F02M 27/04*** | (2006.01) |
| ***H05H 1/00*** | (2006.01) |
| ***F02P 3/01*** | (2006.01) |
| ***H05H 1/46*** | (2006.01) |

(56) References Cited

U.S. PATENT DOCUMENTS

| | | | | |
|---|---|---|---|---|
| 2004/0084036 | A1* | 5/2004 | Porter | F02D 35/027 123/634 |
| 2004/0245085 | A1* | 12/2004 | Srinivasan | B82Y 10/00 204/157.15 |
| 2006/0232214 | A1 | 10/2006 | Seeley | |
| 2008/0272700 | A1* | 11/2008 | Lin | H01J 37/3222 315/111.21 |
| 2009/0314239 | A1* | 12/2009 | Idogawa | F02P 23/045 123/169 R |
| 2010/0296977 | A1* | 11/2010 | Hancock | A61L 2/14 422/186 |
| 2011/0061811 | A1* | 3/2011 | Ito | H01J 37/32935 156/345.28 |
| 2013/0019841 | A1* | 1/2013 | Ando | F02D 41/3041 123/406.12 |

FOREIGN PATENT DOCUMENTS

| | | | |
|---|---|---|---|
| JP | 2010-001827 | A | 1/2010 |
| JP | 2011-134636 | A | 7/2011 |

* cited by examiner

PLASMA GENERATING DEVICE, AND INTERNAL COMBUSTION ENGINE

TECHNICAL FIELD

The present invention relates to a plasma generation device that generates electromagnetic wave plasma and an internal combustion engine that promotes combustion of a fuel air mixture utilizing an electromagnetic wave.

BACKGROUND ART

Conventionally, there is known a plasma generation device that generates electromagnetic wave plasma. For example, Japanese Unexamined Patent Application, Publication No. 2010-001827 discloses an ignition device for an internal combustion engine as a plasma generation device of this kind.

The ignition device for the internal combustion engine disclosed in Japanese Unexamined Patent Application, Publication No. 2010-001827 emits a microwave generated by a microwave oscillation device to a cylinder, thereby generates low temperature plasma. The low temperature plasma thus generated allows a continuous generation of a large number of OH radicals from moisture in fuel air mixture. In the ignition device for the internal combustion engine, the microwave oscillation device is manufactured as a solid state component.

THE DISCLOSURE OF THE INVENTION

Problems to be Solved by the Invention

In order to generate plasma using an electromagnetic wave, a relatively large energy is required. In a plasma generation device of this kind, a large-power electromagnetic wave is required in comparison with the electromagnetic wave used for communication. Therefore, a large amount of heat is generated in an amplifying element of an electromagnetic wave generation device, and the size of the electromagnetic wave generation device may increase for cooling the amplifying element.

The present invention has been made in view of the above described circumstances, and it is an object of the present invention to downsize an electromagnetic wave generation device of a plasma generation device that generates electromagnetic wave plasma by emitting an electromagnetic wave, amplified by a solid state amplifying element, to a target space.

Means for Solving the Problems

In accordance with a first aspect of the present invention, there is provided a plasma generation device including an electromagnetic wave generation device outputting an electromagnetic wave amplified by a solid state amplifying element, and an emission antenna for emitting the electromagnetic wave outputted from the electromagnetic wave generation device to a target space, the plasma generation device generates electromagnetic wave plasma by emitting the electromagnetic wave to the target space from the emission antenna. The electromagnetic wave generation device has a characteristic that an output waveform of the electromagnetic wave outputted by the electromagnetic wave generation device has a peak during a rise, and the electromagnetic wave generation device is adapted to output the electromagnetic wave to the emission antenna without reducing the peak during the rise of the output waveform.

According to the first aspect of the present invention, the output waveform of the electromagnetic wave generation device has a peak during a rise, and the electromagnetic wave generation device is adapted to output the electromagnetic wave to the emission antenna without reducing the peak in the rise of the output waveform (power waveform). During an electromagnetic wave emission period in which the electromagnetic wave is emitted to the target space, the peak appears at the beginning of the output. Here, in a case in which the electromagnetic wave plasma is generated, a large amount of electromagnetic wave energy is required to cause a breakdown for generating the electromagnetic wave plasma. Once the electromagnetic wave plasma is generated, the electromagnetic wave plasma can be sustained with a lower amount of electromagnetic wave energy in comparison with the time of the breakdown. According to the first aspect of the present invention, in view of the above described point, the electromagnetic wave is outputted to the emission antenna without reducing the peak during the rise of the output waveform of the amplifying element.

In accordance with a second aspect of the present invention, in addition to the first aspect of the present invention, the plasma generation device includes a peak enhancement unit that enhances an output of the electromagnetic wave generation device at a period of the peak.

According to the second aspect of the present invention, the output of the electromagnetic wave generation device is enhanced at the period of the peak during the electromagnetic wave emission period.

In accordance with a third aspect of the present invention, there is provided an internal combustion engine including: the plasma generation device according to the first or the second aspect of the present invention; and an internal combustion engine main body formed with a combustion chamber, wherein the plasma generation device generates the electromagnetic wave plasma in the combustion chamber as the target space.

According to the third aspect of the present invention, the plasma generation device generates the electromagnetic wave plasma in the combustion chamber as the target space. In a case in which the plasma is used in a manufacturing process such as etching, an output fluctuation of the electromagnetic wave may fluctuate plasma density and degrade the quality of a product. While on the other hand, in a case in which the plasma is used in the internal combustion engine, the fluctuation in plasma density will hardly exert an adverse influence. According to the third aspect of the present invention, the electromagnetic wave that has a peak during the rise thereof is employed in view of the above described circumstance.

In accordance with a fourth aspect of the present invention, there is provided an internal combustion engine including an internal combustion engine main body formed with a combustion chamber, an electromagnetic wave generation device outputting an electromagnetic wave amplified by means of a solid state amplifying element, and an emission antenna for emitting the electromagnetic wave outputted from the electromagnetic wave generation device to the combustion chamber, wherein the internal combustion engine promotes combustion of fuel air mixture by causing the emission antenna to emit the electromagnetic wave to the combustion chamber, and the electromagnetic wave generation device has a characteristic that an output waveform of the electromagnetic wave outputted by the electromagnetic wave generation device has a peak during a rise, and is adapted to output the electromagnetic wave to the emission antenna without reducing the peak during the rise of the output waveform.

Effect of the Invention

According to the present invention, the electromagnetic wave is outputted to the emission antenna without reducing the peak during the rise of the output waveform of the amplifying element in view of the fact that the electromagnetic wave plasma can be sustained with a low amount of microwave energy after the breakdown. Since only the output at the peak period during the electromagnetic wave emission period is required to be at least a level sufficient to cause the breakdown to occur, it is possible to reduce an average output of the electromagnetic wave generation device. Accordingly, it is possible to reduce heat production of the amplifying element, and thus downsize the electromagnetic wave generation device.

Furthermore, according to the second aspect of the present invention, the output of the electromagnetic wave generation device is enhanced at the peak period during the electromagnetic wave emission period. Accordingly, it is possible to ensure the occurrence of the breakdown, and thus stably generate the electromagnetic wave plasma.

Furthermore, according to the third aspect of the present invention, since the fluctuation in plasma density hardly exerts an adverse influence on the internal combustion engine, the electromagnetic wave that has the peak during the rise thereof is employed. Accordingly, it is possible to downsize the electromagnetic wave generation device virtually without affecting the internal combustion engine.

Especially in the internal combustion engine, there is a case in which plasma is generated under a high pressure such as during a compression stroke. In such a case, the electromagnetic wave is required to have a larger amount of power in order to cause the breakdown to occur in comparison with a case in which the plasma is used in a manufacturing process. According to the third aspect of the present invention, in an internal combustion engine that usually requires a large sized electromagnetic wave generation device, it is possible to downsize the electromagnetic wave generation device.

BEST MODE FOR CARRYING OUT THE INVENTION

Figure 1:
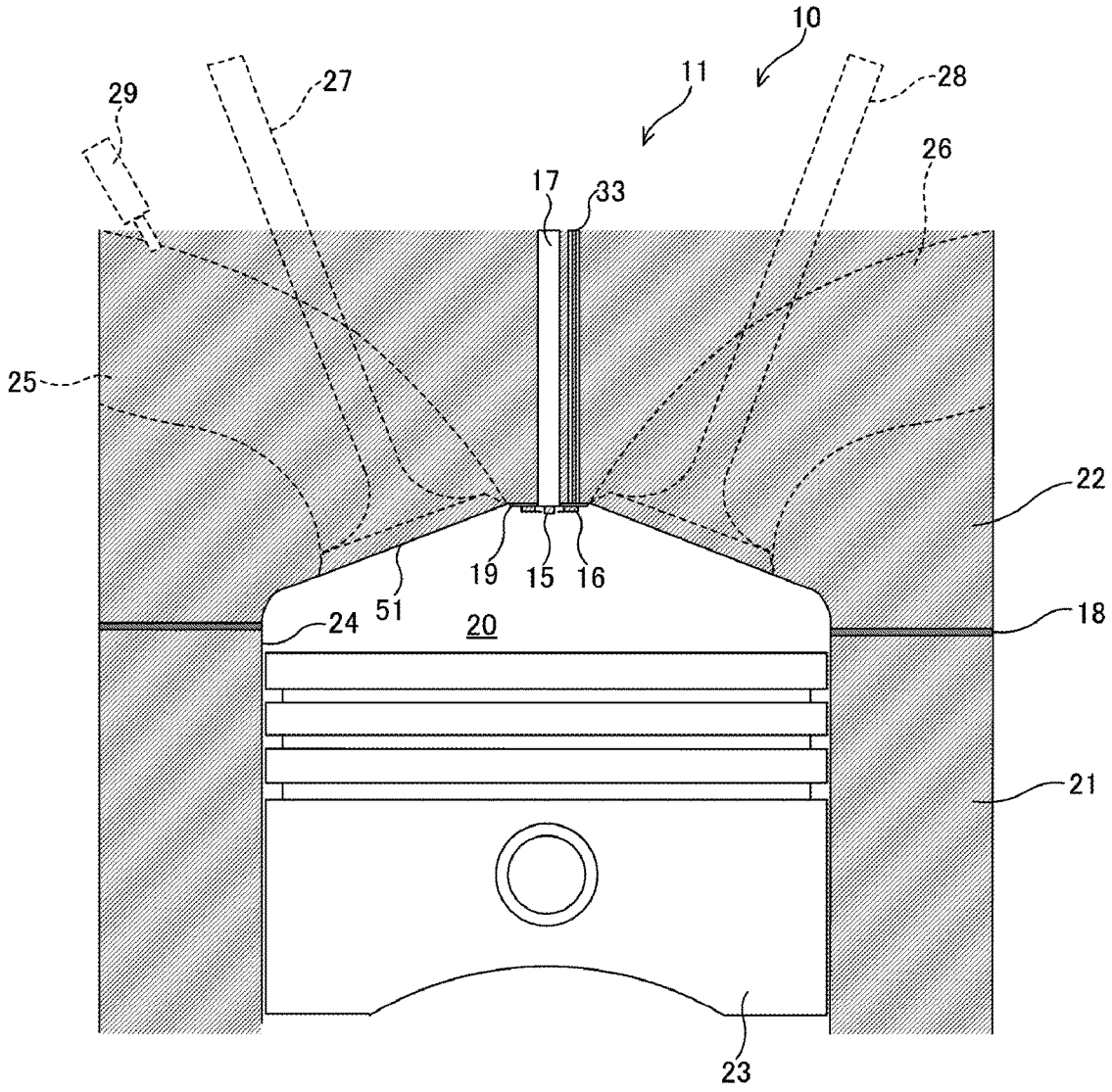
FIG. 1 is a vertical cross sectional view of an internal combustion engine according to a first embodiment.

In the following, a detailed description will be given of embodiments of the present invention with reference to drawings. It should be noted that the following embodiments are merely preferable examples, and do not limit the scope of the present invention, applied field thereof, or application thereof.

First Embodiment

The first embodiment is directed to an internal combustion engine 10 according to the present invention. The internal combustion engine 10 is a reciprocating type internal combustion engine in which pistons 23 reciprocate. The internal combustion engine 10 includes an internal combustion engine main body 11 and a plasma generation device 30. In the internal combustion engine 10, a combustion cycle is repeated in which a fuel air mixture in a combustion chamber 20 is ignited and combusted by way of plasma generated by the plasma generation device 30.

<Internal Combustion Engine Main Body>

As shown in FIG. 1, the internal combustion engine main body 11 includes a cylinder block 21, a cylinder head 22, and the pistons 23. The cylinder block 21 is formed with a plurality of cylinders 24 each having a circular cross section. Inside of each cylinder 24, the piston 23 is reciprocatably mounted. The piston 23 is connected to a crankshaft (not shown) via a connecting rod (not shown). The crankshaft is rotatably supported by the cylinder block 21. While the piston 23 reciprocates in each cylinder 24 in an axial direction of the cylinder 24, the connecting rod converts the reciprocal movement of the piston 23 to rotational movement of the crankshaft.

The cylinder head 22 is placed on the cylinder block 21, and a gasket 18 intervenes between the cylinder block 21 and the cylinder head 22. The combustion chamber 20 has a circular cross section and formed by the cylinder head 22 along with the cylinder 24 and the piston 23. A diameter of the combustion chamber 20 is equal to, for example, approximately a half wavelength of the microwave emitted from an emission antenna 16, which will be described later.

Figure 2:
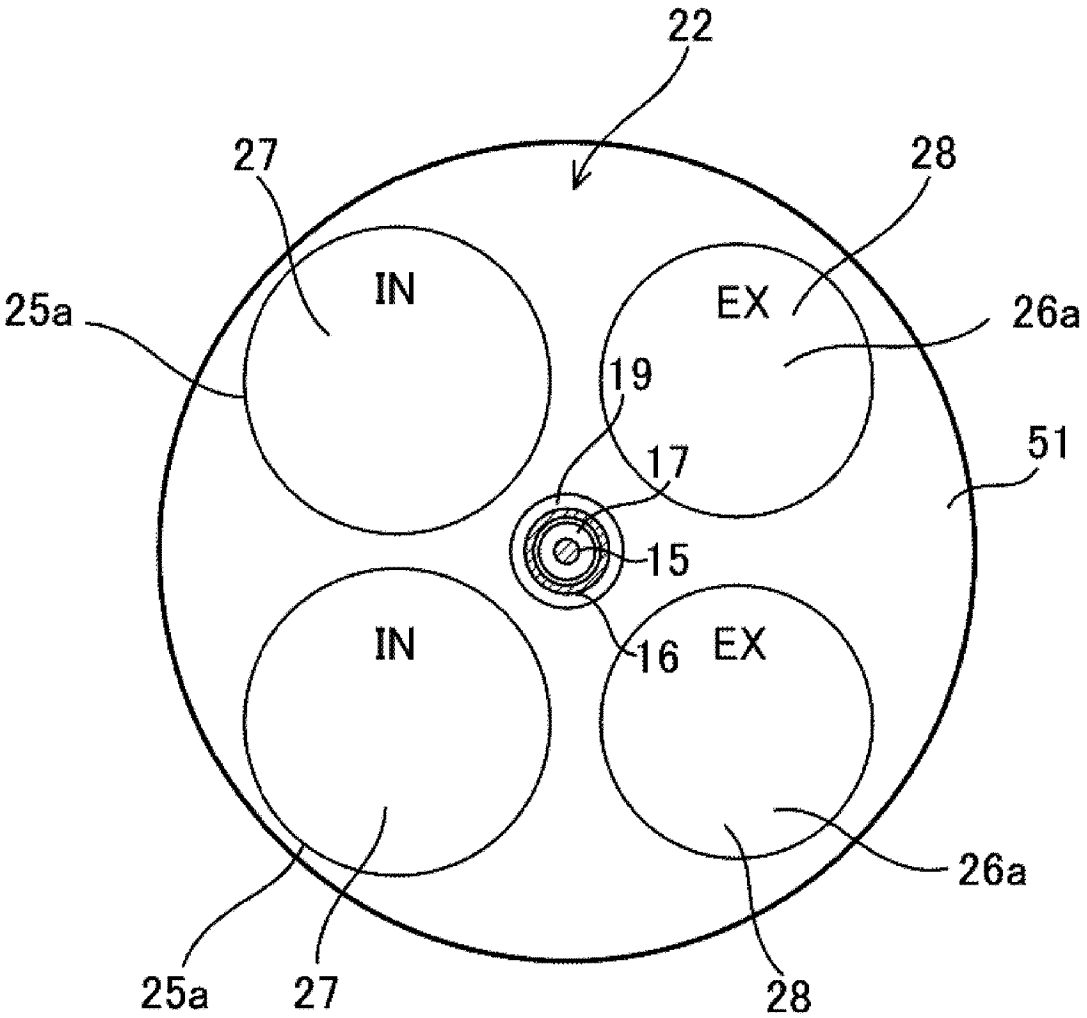
FIG. 2 is a front view of a ceiling surface of a combustion chamber of the internal combustion engine according to the first embodiment.

The cylinder head 22 is provided with one discharge electrode 15 that constitutes a part of a discharge device 12 for each cylinder 24. Each discharge electrode 15 is provided at a tip end of a cylindrical shaped insulator 17 embedded in the cylinder head 22. As shown in FIG. 2, each discharge electrode 15 locates at a central part of a ceiling surface 51 of the combustion chamber 20. The ceiling surface 51 is a surface of the cylinder head 22 and exposed toward the combustion chamber 20.

The cylinder head 22 is formed with intake ports 25 and exhaust ports 26 for each cylinder 24. Each intake port 25 is provided with an intake valve 27 for opening and closing an intake side opening 25*a* of the intake port 25, and an injector 29 for injecting fuel. On the other hand, each exhaust port 26 is provided with an exhaust valve 28 for opening and closing an exhaust side opening 26*a* of the exhaust port 26. The internal combustion engine 10 is designed such that the intake ports 25 form a strong tumble flow in the combustion chamber 20.

<Plasma Generation Device>

Figure 3:
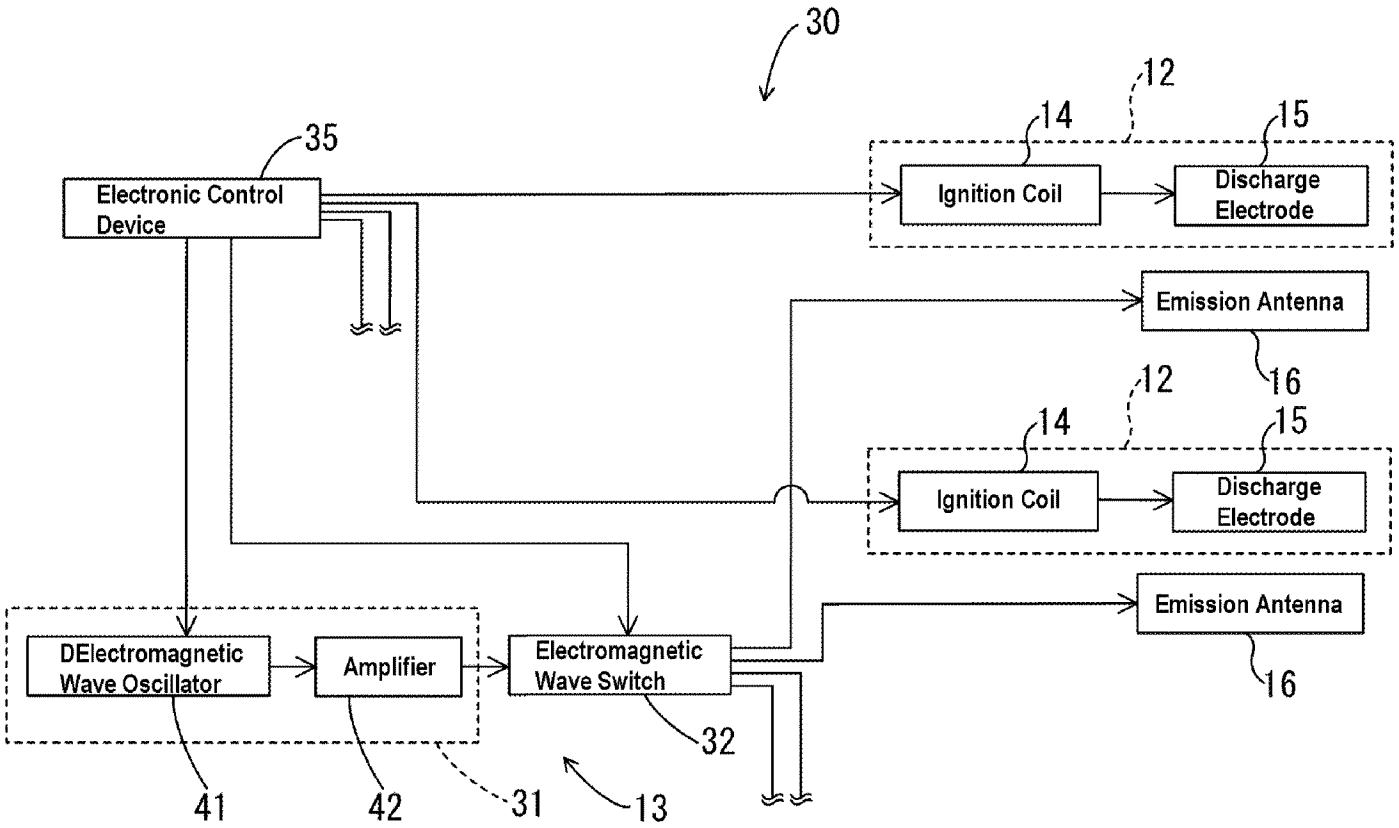
FIG. 3 is a block diagram of a plasma generation device according to the first embodiment.

As shown in FIG. 3, the plasma generation device 30 includes the discharge device 12 and an electromagnetic wave emission device 13.

The discharge device 12 is provided for each combustion chamber 20. Each discharge device 12 includes an ignition coil 14 (a high voltage generation device) that generates a high voltage pulse and the discharge electrode 15 which the high voltage pulse outputted from the ignition coil 14 is applied to.

The ignition coil 14 is connected to a direct current power supply (not shown). The ignition coil 14, upon receiving an ignition signal from an electronic control device 35, boosts a voltage applied from the direct current power supply, and outputs the boosted high voltage pulse to the discharge electrode 15.

The discharge electrode 15 is provided in the cylinder head 22 at an end surface of the insulator 17 that extends from the ceiling surface 51 of the combustion chamber 20 up to an outer surface of the cylinder head 22. An electric wire (not shown) passes through the inside of the insulator 17. The electric wire is adapted to electrically connect the ignition coil 14 with the discharge electrode 15. The electric wire and the discharge electrode 15 are both insulated from the cylinder head 22 by the insulator 17. The discharge electrode 15 forms a discharge gap along with the emission antenna 16, which will be described later. When the high voltage pulse is supplied to the discharge electrode 15, a spark discharge occurs at the discharge gap.

The electromagnetic wave emission device 13 includes an electromagnetic wave generation device 31, an electromagnetic wave switch 32, and the emission antenna 16. This means that one electromagnetic wave generation device 31 and one electromagnetic wave switch 32 are provided for the electromagnetic wave emission device 13, and one emission antenna 16 is provided for each combustion chamber 20.

The electromagnetic wave generation device 31, upon receiving an electromagnetic wave drive signal from the electronic control device 35, outputs a microwave pulse. As shown in FIG. 3, the electromagnetic wave generation device 31 includes an electromagnetic wave oscillator 41 for generating the microwave pulse and an amplifier 42 for amplifying the microwave pulse generated by the electromagnetic wave oscillator 41.

More particularly, the electromagnetic wave oscillator 41 is constituted by a dielectric oscillator. The electromagnetic wave oscillator 41 may be constituted by the other type of oscillator such as a crystal oscillator. While on the other hand, the amplifier 42 is constituted by an amplifier circuit provided with a solid state amplifying element (such as a bipolar transistor) and adapted to amplify the microwave pulse inputted from the electromagnetic wave oscillator 41. The amplifier circuit carries out the class C amplification. As the amplifier circuit, an amplifier circuit that carries out the class B amplification may be employed as well.

Here, for example, the output of the bipolar transistor gradually decreases owing to the temperature rise after the start of the amplification. This means that a peak of the output appears at the rise period. In the field of communication, the output fluctuation is suppressed by the gain adjustment control through the use of an AGC (Automatic Gain Control) circuit, for example.

Figure 4:
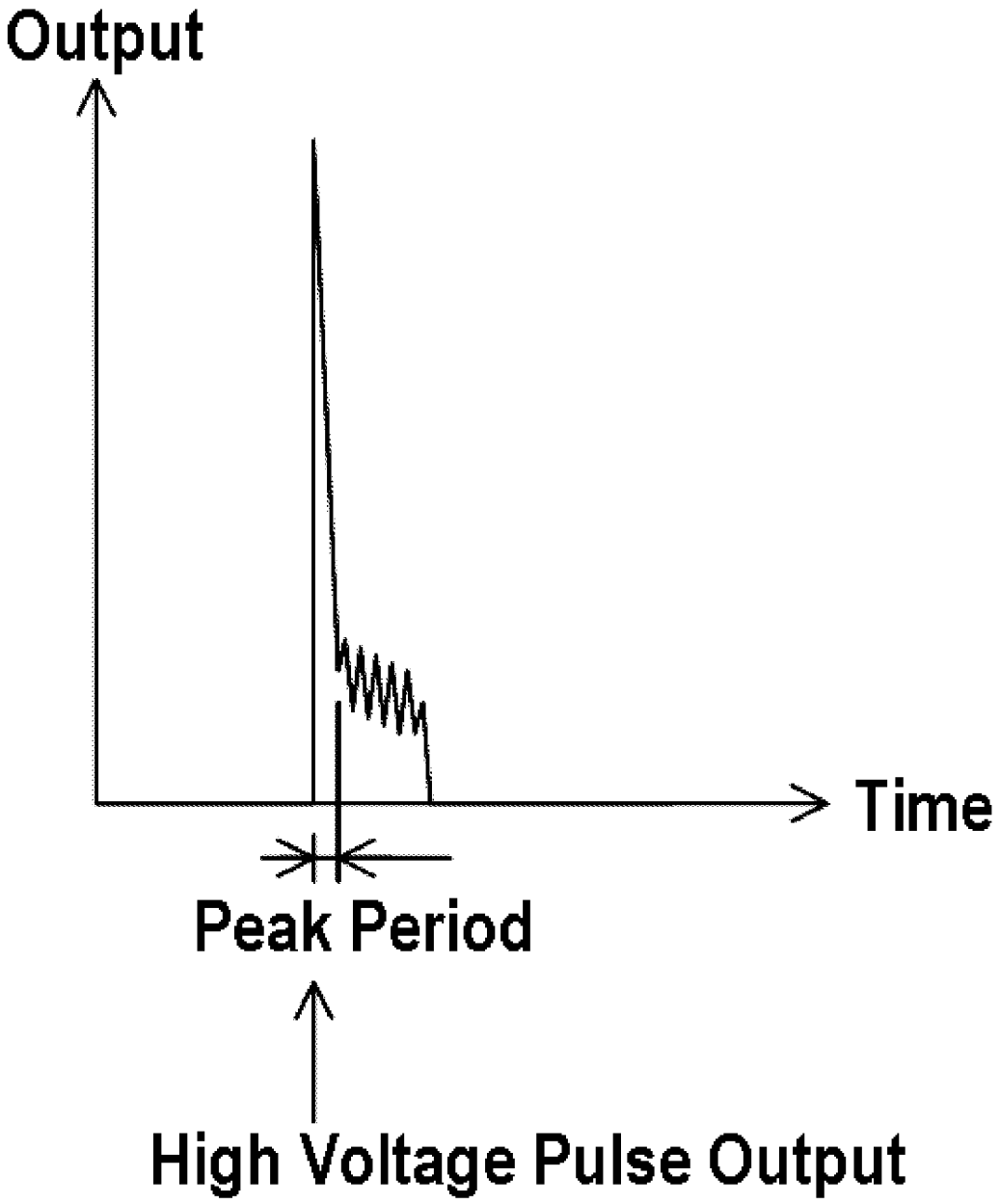
FIG. 4 is a diagram showing a waveform of a microwave pulse according to the first embodiment.

However, in a case of microwave plasma generation, a large amount of energy of the microwave is required at the time of the breakdown when microwave plasma is generated from a state in which the microwave plasma does not exist. Once the microwave plasma is generated, the microwave plasma can be sustained with a lower amount of energy of the microwave in comparison with the time of the breakdown. Furthermore, in a case in which the plasma is used in the internal combustion engine, unlike a case in which the plasma is used in a manufacturing process such as etching, the fluctuation in plasma density hardly exerts an adverse influence. According to the first embodiment, in view of the above described circumstances, the electromagnetic wave generation device 31 outputs the microwave pulse of the waveform as shown in FIG. 4 to the emission antenna 16 without reducing the peak appearing at the rise of the output waveform. According to the first embodiment, the electromagnetic wave generation device 31 is not provided with a unit (such as the AGC circuit) for reducing the peak during the rise of the output waveform of the amplifier 42 in a transmission line from the amplifier 42 up to the emission antenna 16.

The electromagnetic wave switch 32 includes an input terminal and a plurality of output terminals respectively provided for emission antennae 16. The input terminal is connected to the electromagnetic wave generation device 31. Each output terminal is connected to the corresponding emission antenna 16. The electromagnetic wave switch 32 is adapted to switch a supply destination of the microwave outputted from the electromagnetic wave generation device 31 in turn from among the plurality of emission antennae 16 under the control of the electronic control device 35.

The emission antenna 16 is formed in a circular shape and provided on the ceiling surface 51 of the combustion chamber 20 in a manner to surround the discharge electrode 15. The discharge electrode 15 and the emission antenna 16 are arranged concentrically with each other. The emission antenna 16 is provided on an insulation layer 19 formed in a ring shape on the ceiling surface 51 of the combustion chamber 20. The emission antenna 16 is electrically connected to the output terminal of the electromagnetic wave switch 32 through a coaxial line 33 embedded in the cylinder head 22. The emission antenna 16 may be formed in a C-letter shape.

According to the first embodiment, a distance between the discharge electrode 15 and the emission antenna 16 is configured so that the high voltage pulse outputted from the ignition coil 14 causes an insulation breakdown to occur. The distance between the discharge electrode 15 and the emission antenna 16 may be, for example, 2 to 3 mm. The emission antenna 16 serves a role as a ground electrode of an ignition plug. The plasma generation device 30 causes the ignition coil 14 to output the high voltage pulse so as to generate the discharge plasma at the discharge gap while causing the electromagnetic wave generation device 31 to output the microwave pulse so that the emission antenna 16 emits the microwave pulse, thereby enlarging the discharge plasma and thus generating a comparatively large scale of microwave plasma.

<Plasma Generation Operation>

A plasma generation operation of the plasma generation device 30 will be described hereinafter.

At an ignition timing when the piston 23 locates immediately before the compression top dead center, the internal combustion engine 10 performs an ignition operation of igniting the fuel air mixture byway of the microwave plasma generated by the plasma generation device 30. During the ignition operation, the electronic control device 35 outputs the ignition signal and the electromagnetic wave drive signal at the same timing. Then, the ignition coil 14, upon receiving the ignition signal, outputs the high voltage pulse, and the high voltage pulse is applied to the discharge electrode 15. As a result of this, a spark discharge occurs at the discharge gap between the discharge electrode 15 and the emission antenna 16.

Meanwhile, in the electromagnetic wave emission device 13, the electromagnetic wave generation device 31, upon receiving the electromagnetic wave drive signal, outputs the microwave pulse. As shown in FIG. 4, the electromagnetic wave emission device 13 starts to output the microwave pulse at an output timing of the high voltage pulse of the ignition coil 14. The microwave pulse is emitted from the emission antenna 16. As a result of this, the discharge plasma generated by the spark discharge absorbs the energy of the microwave and expands, and the fuel air mixture is ignited by the expanded microwave plasma. A flame spreads outwardly from an ignition location where the fuel air mixture is ignited toward a wall surface of the cylinder 24.

According to the first embodiment, the electronic control device 35 outputs the electromagnetic wave drive signal immediately after the ignition of the fuel air mixture, as well. Then, the electromagnetic wave generation device 31 outputs the microwave pulse. The microwave pulse is emitted from the emission antenna 16.

The microwave pulse is emitted before a flame surface passes through the location of the emission antenna 16. In the vicinity of the emission antenna 16, a strong electric field region is formed by the microwave. The flame surface receives energy from the microwave while passing through the strong electric field region and accelerates the propagation speed. When the energy of the microwave is strong, the microwave plasma is generated in the strong electric field region before the flame surface passes therethrough. Since active species such as OH radicals are generated in a region where the microwave plasma is generated, the flame surface further accelerates the propagation speed while passing through the strong electric field region owing to the active species.

Effect of First Embodiment

According to the first embodiment, in view of the fact that the microwave plasma can be sustained with low microwave energy after the breakdown, the microwave pulse is outputted to the emission antenna 16 without reducing the peak appearing during the rise of the output waveform of the amplifying element. As a result of this, since energy of the microwave pulse is required to be equal to or more than a level sufficient for the discharge plasma to be expanded (broken-down) only in the peak period during an oscillation period of the microwave pulse, it is possible to reduce an average output of the electromagnetic wave generation device 31. Accordingly, it is possible to reduce heat production of the amplifying element, and thus downsize the electromagnetic wave generation device 31.

Furthermore, according to the first embodiment, the microwave pulse that has a peak during the rise thereof is employed in view of the fact that the fluctuation in plasma density hardly exerts an adverse influence on the internal combustion engine main body 11. Accordingly, it is possible to downsize the electromagnetic wave generation device 31 virtually without affecting the internal combustion engine main body 11.

Especially, according to the first embodiment, the microwave plasma is generated under the high pressure during the compression stroke, the microwave plasma is required to have a larger amount of power in order to cause the breakdown to occur in comparison with the case in which the plasma is used in the manufacturing process. According to the first embodiment, it is possible to downsize the electromagnetic wave generation device 31 in the internal combustion engine 10, which would otherwise require a large sized electromagnetic wave generation device 31.

First Modified Example of Embodiment

Figure 5:
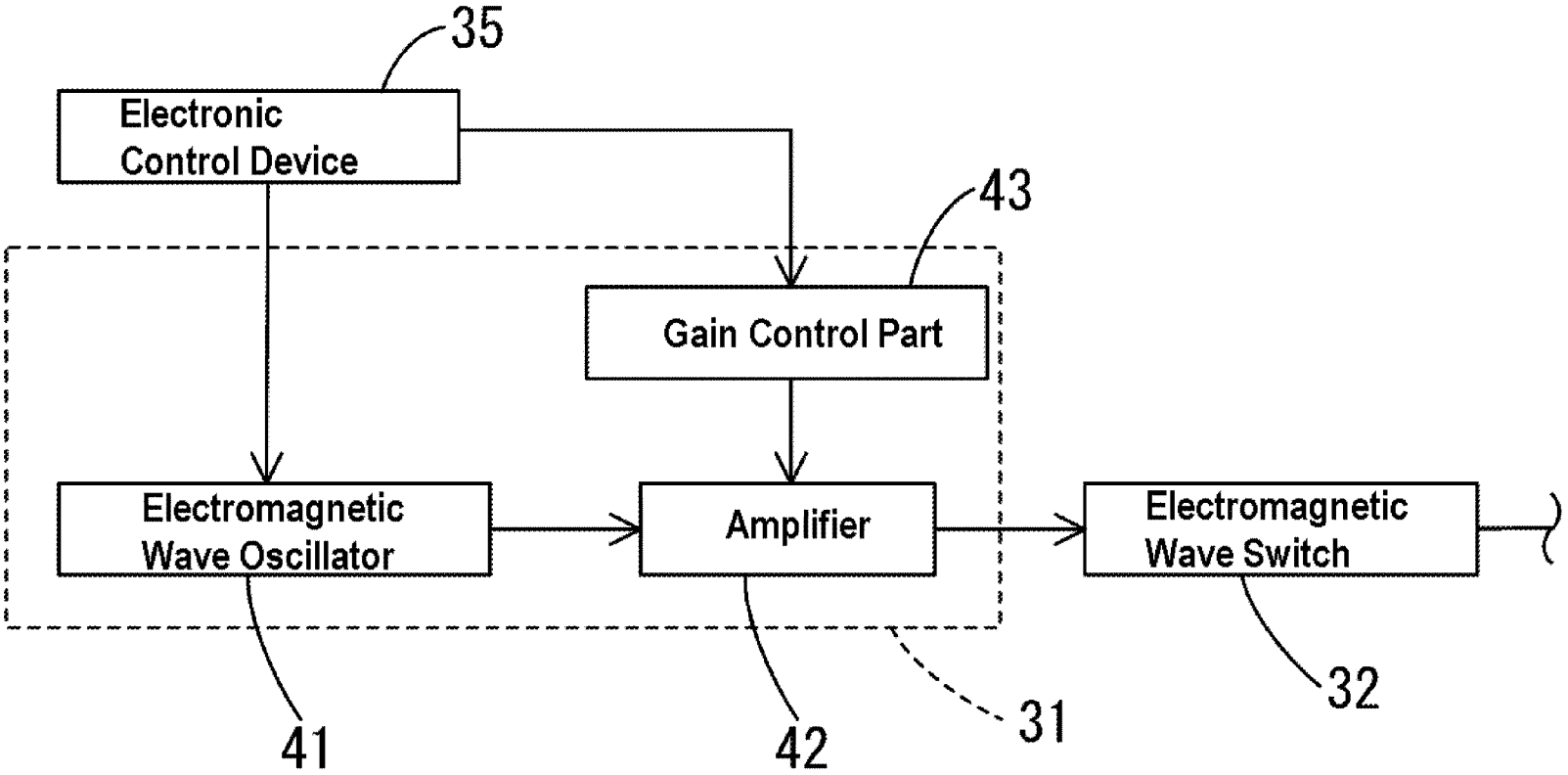
FIG. 5 is a block diagram of an electromagnetic wave generation device according to a first modified example of the first embodiment.

According to a first modified example, as shown in FIG. 5, the electromagnetic wave generation device 31 includes a gain control part 43. The gain control part 43 constitutes a peak enhancing unit that enhances the output of the amplifier 42 during the peak period (a period from a rise to a fall of the peak) during which the peak is present from the oscillation period of the microwave pulse.

The gain control part 43 increases a gain rate of the amplifier circuit only during the peak period in the oscillation period of the microwave pulse. The gain control part 43 changes the gain rate of the amplifier circuit by applying a gain control voltage to a gate of the amplifying element (such as a dual gate FET). The gain control part 43 increases a gain rate of the amplifier circuit by applying the gain control voltage so that a gate voltage value of the FET should be equal to a source voltage value (for example, the ground potential) only during the peak period.

The electronic control device 35 outputs an amplification start signal to the gain control part 43 simultaneously with the electromagnetic wave drive signal that defines the oscillation period of the microwave pulse. Then, the gain control part 43, upon receiving the amplification start signal from the electronic control device 35, starts to increase the gain rate of the amplifier circuit. The amplifier 42 starts to amplify the microwave pulse inputted from the electromagnetic wave oscillator 41. The gain control part 43 terminates an operation of increasing the gain rate of the amplifier circuit when the gain control part 43 detects the fall of the peak of the microwave pulse while detecting a voltage value of the amplifier 42 at the output side thereof, for example. The amplifier 42 terminates an operation of amplifying the microwave pulse at an end timing of the peak period.

According to the first modified example, the output of the electromagnetic wave generation device 31 is increased during the peak period in the oscillation period of the microwave pulse. Accordingly, it is possible to ensure the occurrence of the breakdown, and thus to stably generate the microwave plasma.

The gain control part 43 may decrease the gain rate after the peak period by applying a deep bias to the gain control voltage in a negative voltage direction after the peak period during the oscillation period of the microwave pulse. In this case, the gain rate is set to a level sufficient to sustain the microwave plasma.

Second Modified Example of First Embodiment

According to the second modified example, unlike the first modified example in which the gate bias voltage is changed, the drain voltage of the amplifier 42 is changed, thereby increasing the gain rate of the amplifier circuit in the peak period from the oscillation period of the microwave pulse.

Second Embodiment

Figure 6:
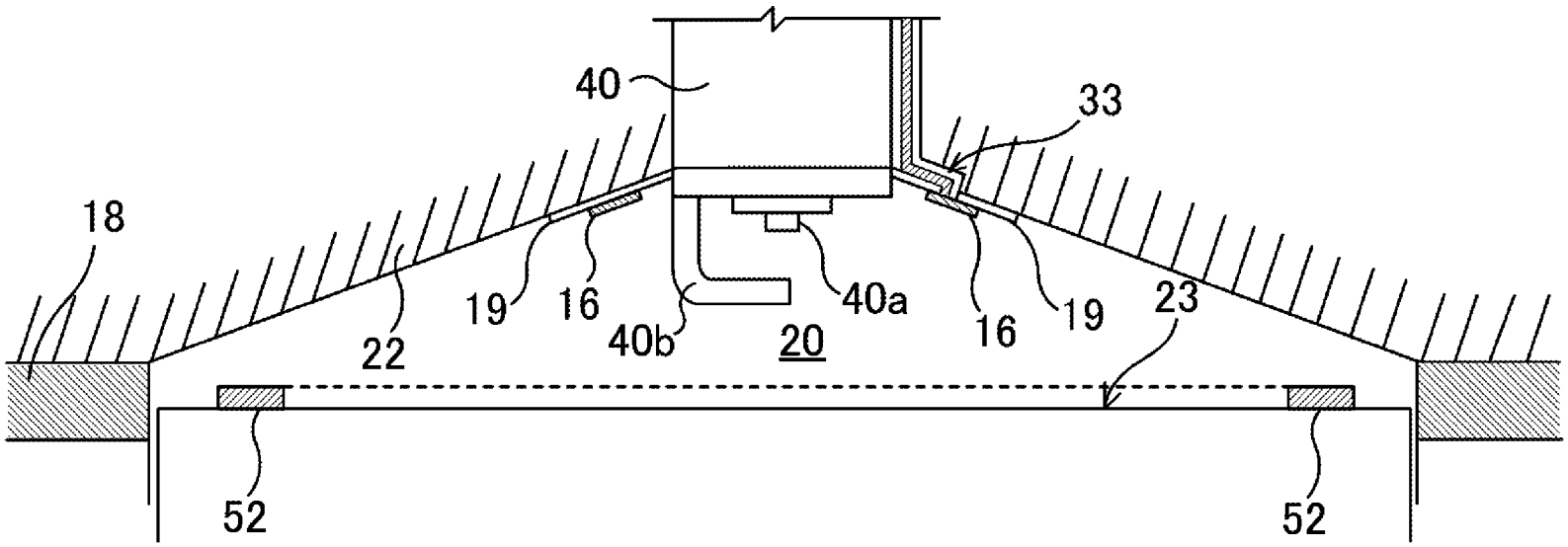
FIG. 6 is a vertical cross sectional view of a main part of an internal combustion engine according to a second embodiment.

According to the second embodiment, the discharge device 12 includes, in addition to the ignition coil 14, an ignition plug 40 provided with a central electrode 40*a* (equivalent to the discharge electrode according to the first embodiment) and a ground electrode 40*b* at a tip end part of the ignition plug 40. As shown in FIG. 6, the ignition plug 40 is provided on the ceiling surface 51 of the combustion chamber 20. The central electrode 40*a* of the ignition plug 40 is supplied with the high voltage pulse from the ignition coil 14. As the high voltage pulse, a negative voltage is applied.

Furthermore, the electromagnetic wave emission device 13 includes the electromagnetic wave generation device 31, the electromagnetic wave switch 32, and the emission antenna 16. The emission antenna 16 is provided on the ceiling surface 51 of the combustion chamber 20. The emission antenna 16 is formed in the circular shape viewed from the front of the ceiling surface 51 of the combustion chamber 20 in a manner to surround the tip end part of the ignition plug 40. The emission antenna 16 may be formed in the C-letter shape viewed from the front of the ceiling surface 51 of the combustion chamber 20.

The emission antenna 16 is laminated on the insulation layer 19 formed in the ring shape on a periphery of a fixing hole of the ignition plug 40 on the ceiling surface 51 of the combustion chamber 20. The insulation layer 19 is formed by, for example, thermal spraying of an insulation material. The emission antenna 16 is electrically insulated from the cylinder head 22 by the insulation layer 19.

According to the second embodiment, a receiving antenna 52 is provided on a top surface of the piston 23. The receiving antenna 52 is formed in the ring shape, and is provided at a location in the vicinity of an outer periphery of the top surface of the piston 23. The receiving antenna 52 is electrically insulated from the piston 23 by an insulation layer (not shown) and is provided in a state of electrical floating.

According to the second embodiment, a microwave is emitted from the emission antenna 16 while the flame is propagated after the ignition of the fuel air mixture. Then, a strong electric field region is formed by the microwave in the vicinity of the receiving antenna 52. The flame surface receives energy from the microwave while passing through the strong electric field region and accelerates the propagation speed. In a case in which the energy of the microwave is high, the microwave plasma is generated in the strong electric field region before the flame surface passes therethrough. Since active species such as OH radicals are generated in a region where the microwave plasma is generated, the flame surface further accelerates the propagation speed while passing through the strong electric field region owing to the active species.

Other Embodiments

The embodiments described above may also be configured as follows.

In the embodiments described above, in a case in which a casing (package) of the electromagnetic wave generation device 31 and an insulator of the transmission line of the microwave are both constituted by ceramic, the casing and the insulator of the transmission line may be made integrated with each other. In this case, it is possible to omit a connector on an output side of the electromagnetic wave generation device 31.

Furthermore, in the embodiments described above, a reflection wave of the microwave may be monitored during the oscillation period of the microwave pulse and the oscillation frequency (wavelength) of the microwave outputted from the electromagnetic wave generation device 31 may be varied so that the reflection wave of the microwave should be reduced.

Furthermore, in the embodiments described above, the emission antenna 16 and/or the receiving antenna 52 may be covered by an insulator or a dielectric.

Furthermore, in the embodiments described above, it has been described that the plasma generation device 30 generates the plasma by expanding the discharge plasma by way of the electromagnetic wave. However, the electromagnetic wave plasma may be generated by way of the electromagnetic wave alone.

Furthermore, in the embodiments described above, the plasma generation device 30 may generate the microwave plasma in the combustion chamber 20 during the intake stroke.

Furthermore, in the embodiments described above, the plasma generation device 30 may be applied to a material analysis device. The material analysis device is a device that identifies material using SIBS (Spark-Induced Breakdown Spectroscopy). The material analysis device generates discharge plasma by way of a spark discharge in the vicinity of a surface of an analysis target material such as metal, and expands the discharge plasma by way of a microwave. As a result of this, microwave plasma is generated, and the analysis target material is ionized. The material analysis device analyzes luminescence of the ionized analysis target material by spectroscopy. The material analysis device detects a peak frequency in a spectrum of the luminescence, and identifies the material based on the peak frequency. The material analysis device may be a device that identifies material using LIBS (Laser-Induced Breakdown Spectroscopy). In this case, in place of the spark discharge, a laser is employed and condensed so as to generate plasma, and the plasma is expanded by way of a microwave.

INDUSTRIAL APPLICABILITY

From the foregoing description, it is to be understood that the present invention is useful in relation to a plasma generation device that generates electromagnetic wave plasma and an internal combustion engine that promotes combustion of fuel air mixture utilizing an electromagnetic wave.

EXPLANATION OF REFERENCE NUMERALS

10 Internal Combustion Engine
11 Internal Combustion Engine Main Body
12 Ignition Device
13 Electromagnetic Wave Emission Device
15 Discharge Electrode
16 Emission Antenna
20 Combustion Chamber
30 Plasma Generation Device
31 Electromagnetic Wave Generation Device
41 Electromagnetic Wave Oscillator
42 Amplifier
43 Gain Control Part (Peak Enhancing Unit)

What is claimed is:

1. A plasma generation device comprising an electromagnetic wave generation device outputting an electromagnetic wave amplified by a solid state amplifying element, and an emission antenna for emitting the electromagnetic wave outputted from the electromagnetic wave generation device to a target space, the plasma generation device generating electromagnetic wave plasma by emitting the electromagnetic wave to the target space from the emission antenna, wherein the electromagnetic wave generation device is configured to output an electromagnetic wave with an output waveform which has a short high output peak period and a lower output period which follows the short high output peak period, a peak of the output waveform being a high voltage pulse output in the short high output peak period, and is configured to output the electromagnetic wave to the emission antenna without reducing the peak in the short high output peak period.

2. The plasma generation device according to claim 1, wherein the plasma generation device includes an amplifier that enhances an output of the electromagnetic wave generation device so as to cause the high voltage pulse output in the short high output peak period.

3. An internal combustion engine comprising:

the plasma generation device according to claim 1; and an internal combustion engine main body formed with a combustion chamber, wherein the plasma generation device generates the electromagnetic wave plasma in the combustion chamber as the target space.

4. An internal combustion engine comprising:

an internal combustion engine main body formed with a combustion chamber, an electromagnetic wave generation device outputting an electromagnetic wave amplified by means of a solid state amplifying element, and an emission antenna for emitting the electromagnetic wave outputted from the electromagnetic wave generation device to the combustion chamber, the internal combustion engine promoting combustion of fuel air mixture by causing the emission antenna to emit the electromagnetic wave to the combustion chamber, wherein the electromagnetic wave generation device is configured to output an electromagnetic wave with an output waveform which has a short high output peak period and a lower output period which follows the short high output peak period, a peak of the output waveform being a high voltage pulse output in the short high output peak period, and is configured to output the electromagnetic wave to the emission antenna without reducing the peak appearing in short high output peak period.

5. An internal combustion engine comprising:

the plasma generation device according to claim 2; and an internal combustion engine main body formed with a combustion chamber, wherein the plasma generation device generates the electromagnetic wave plasma in the combustion chamber as the target space.

6. The plasma generation device according to claim 2, wherein the amplifier is a bipolar transistor.

7. The plasma generation device according to claim 3, wherein the electromagnetic wave generation device comprises a bipolar transistor.

8. The plasma generation device according to claim 4, wherein the electromagnetic wave generation device comprises a bipolar transistor.

9. The plasma generation device according to claim 5, wherein the electromagnetic wave generation device comprises a bipolar transistor.

* * * * *